United States Patent [19]

Kleefeldt

[11] 4,364,249

[45] Dec. 21, 1982

[54] CENTRAL DOOR-LOCK SYSTEM FOR MOTOR VEHICLES

[75] Inventor: Frank Kleefeldt, Heiligenhaus, Fed. Rep. of Germany

[73] Assignee: Kiekert GmbH & Co. Kommanditgesellschaft, Heiligenhaus, Fed. Rep. of Germany

[21] Appl. No.: 132,978

[22] Filed: Mar. 24, 1980

[30] Foreign Application Priority Data

Mar. 24, 1979 [DE] Fed. Rep. of Germany ..... 2911680
Mar. 24, 1979 [DE] Fed. Rep. of Germany ..... 2911681

[51] Int. Cl.[3] ..... E05B 65/36; E05B 47/02

[52] U.S. Cl. ..... 70/264; 70/280; 292/144; 292/201; 292/DIG. 23; 292/DIG. 25

[58] Field of Search ..... 70/262–264, 70/280, 283, 237, 256; 292/144, 201, DIG. 3, DIG. 14, DIG. 25, DIG. 23

[56] References Cited

U.S. PATENT DOCUMENTS 3,520,159 7/1970 Swanney ..... 70/264 X
3,653,237 4/1972 DuRocher ..... 70/264
4,135,377 1/1979 Kleefeldt et al. ..... 70/264

*Primary Examiner*—William E. Lyddane
*Attorney, Agent, or Firm*—Karl F. Ross

[57] ABSTRACT

A central door-lock system has a plurality of door latches each of which is provided with a detent displaceable between open and closed positions for allowing the door to open and for holding it closed. This detent can be acted on by a manual door-opening handle through mechanism including a primary latch member which is connected to the handle and connectable to the detent and which is movable between a lock position preventing the handle from displacing the detent between the open and closed positions and an unlock position permitting the handle to displace the detent between the open and closed positions. A secondary latch member is displaceable between a lock position urging the primary latch member into the respective lock position, an unlock position permitting the primary latch member to move freely between the respective lock and unlock positions, and an antitheft position positively holding the primary member in the respective lock position. Each latch is operated by a servoactuator having a servomotor connected to an actuator element for displacing the respective secondary latch member between the respective lock, unlock an antitheft positions. A central switch is connected to all of the servomotors to operate them jointly and thereby jointly displace the secondary latch members between the respective positions.

10 Claims, 6 Drawing Figures

CENTRAL DOOR-LOCK SYSTEM FOR MOTOR VEHICLES

FIELD OF THE INVENTION

The present invention relates to a central door-lock system for a motor vehicle. More particularly this invention concerns such a system which allows all of the doors—including the trunk and hood doors—of a motor vehicle to be locked and unlocked from a single central location.

BACKGROUND OF THE INVENTION

It is known to provide large cars and the like with central door-lock systems. Such a system normally is connected to the door lock of the driver's door so that when this door is locked or unlocked all of the other door locks of the vehicle are simultaneously operated. This system is particularly convenient in a large vehicle where it is very difficult for the driver to reach back or across to open any of the other doors.

Such systems normally use standard door latches, each of which normally has a detent lockingly engageable with a bolt or pin on the respective doorpost and displaceable between and open and closed position allowing the door to be separated from the respective doorpost or securely holding the door to its respective doorpost. Mechanism inside the lock allows this detent to be operated by inside and outside door handles, and this mechanism itself is normally controlled by inside and outside door locks that allow the inside and outside door handles to be uncoupled from the detent. Thus when the door is locked it cannot be opened from either the inside or outside handle, and this locking can be carried out either by means of an externally accessible key-operated door lock or by means of an internal door button or lever. Each such latch is associated with a respective servo-actuator that in the simplest instance is a double-acting solenoid coupled to the inside door-lock button and operable from the driver's position to lock and unlock the doors.

Such systems do not, however, normally offer any additional security against breaking-into or theft of the motor vehicle. Thus it is possible for a burglar to simply smash or pry open a window, then reach in and unlock the respective door by means of the respective inside door-lock button or lever. The fact that the vehicle is equipped with a central lock system is irrelevant in such a situation.

Although it has been suggested to incorporate some particular precautions in a central locking system to discourage theft, such arrangements normally have added substantially to the cost of the system. What is more such arrangements normally require the standard door latches of a motor vehicle to be entirely rebuilt or replaced with special ones that work together with the new antitheft means. Such an arrangement can be seen from my copending application Ser. No. 132,977, whose entire disclosure is herewith incorporated by reference.

OBJECTS OF THE INVENTION

It is therefore an object of the present invention to provide an improved central lock system for a motor vehicle.

Another object is to provide such a system which makes entry into the vehicle particularly difficult.

Yet another object is to provide such a system which can be incorporated in a standard central lock system having standard door latches without greatly adding to the expense thereof.

SUMMARY OF THE INVENTION

These objects are attained according to the instant invention in a central door-lock system having door latches of the above-described type, having a detent and a manual door-opening handle as well as primary and secondary latch members. The primary latch member is connected to the handle and is connectable to the detent and movable between a locked position preventing the handle from displacing the detent between the open and closed positions and an unlocked position permitting the handle to displace the detent between the open and closed positions. The secondary latch member is displaceable between a locked position urging the primary latch member into the respective locked position, an unlocked position permitting the primary latch member to move between the respective lock and unlock positions, and according to this invention into an antitheft position positively holding the primary member in the respective lock position. The servoactuators each have an actuator element connected to the respective secondary latch member and a servomotor that displaces the respective secondary latch member via the respective actuator element between the respective lock, unlock and antitheft positions. A central switch is connected to all of these servomotors to operate same jointly and thereby jointly displace the secondary latch members between the respective positions. Thus in accordance with the instant invention the secondary latch member merely urges the primary latch member into the lock position, so that even if the central lock system is in the lock position so that all the doors are locked, it is possible to manually unlock any one of the doors without having to unlock them all, this door however automatically relocking itself the instant pressure is released from the inside or outside door lock. In the antitheft position, however, the secondary member positively holds the primary member in the lock position so that it is impossible to open the door latch either from inside by means of the inside door button or lever or from the outside by means of the key. The secondary latch member can be incorporated in a standard door lock at very low cost and will not interfere whatsoever with operation of the latch when it is in the lock or unlock positions.

According to the instant invention the switch that operates the various servomotors may be incorporated directly into the driver's door latch. The antitheft position can only be switched into from outside the vehicle, either by operation of the outside door-locking cylinder or by a separate switch incorporated in the vehicle burglar alarm, so that it is impossible for passengers to be locked inside the vehicle. It is possible to have a small servomotor-operated switch controlled by a door-locking key.

According to the instant invention the servoactuators each have a motor with a rotary output and a threaded spindle carried on this rotary output. A nut threaded on the spindle engages via an overload coupling with a two-arm lever that is in turn rigidly connected to the respective secondary lock member. When in the antitheft position this nut engages positively with the other arm of the two-arm lever so that in this antitheft position the entire system is rigidly locked together. Nonetheless in the lock or unlock positions it is possible for the two-arm lever to move relative to the nut if necessary, greatly reducing the risk of having the servoactuator burn out. The use of a threaded spindle and nut as a sort of one-way coupling ensures that even if considerable force is applied to the latch when in the antitheft position it will not be movable into the unlock position without largely destroying it.

According to further features of this invention the detent constitutes a pivotal locking fork that is held in the closed position by means of a pivotal pawl. Both of the latch members of each latch are provided with arms that move into the path of the lock pawl in the lock and antitheft positions of the primary and secondary members, respectively, so as positively to prevent this lock pawl from releasing the fork and allowing it to assume the open position. Thus not only are the door handles uncoupled from the pawl in the lock and antitheft positions, but the primary and secondary members are aligned with the latch pawl in such a manner as to prevent its operation even by acting directly on the mechanism of the latch.

The system according to the instant invention therefore makes it extremely difficult to enter a vehicle equipped with it. Even if the thief is willing to smash a window so as to gain access to the interior of the vehicle, it will still be impossible to open the door. Only a person in possession of the key that operates the central switch would be able to operate the system and unlock the doors.

SPECIFIC DESCRIPTION

Figure 1:
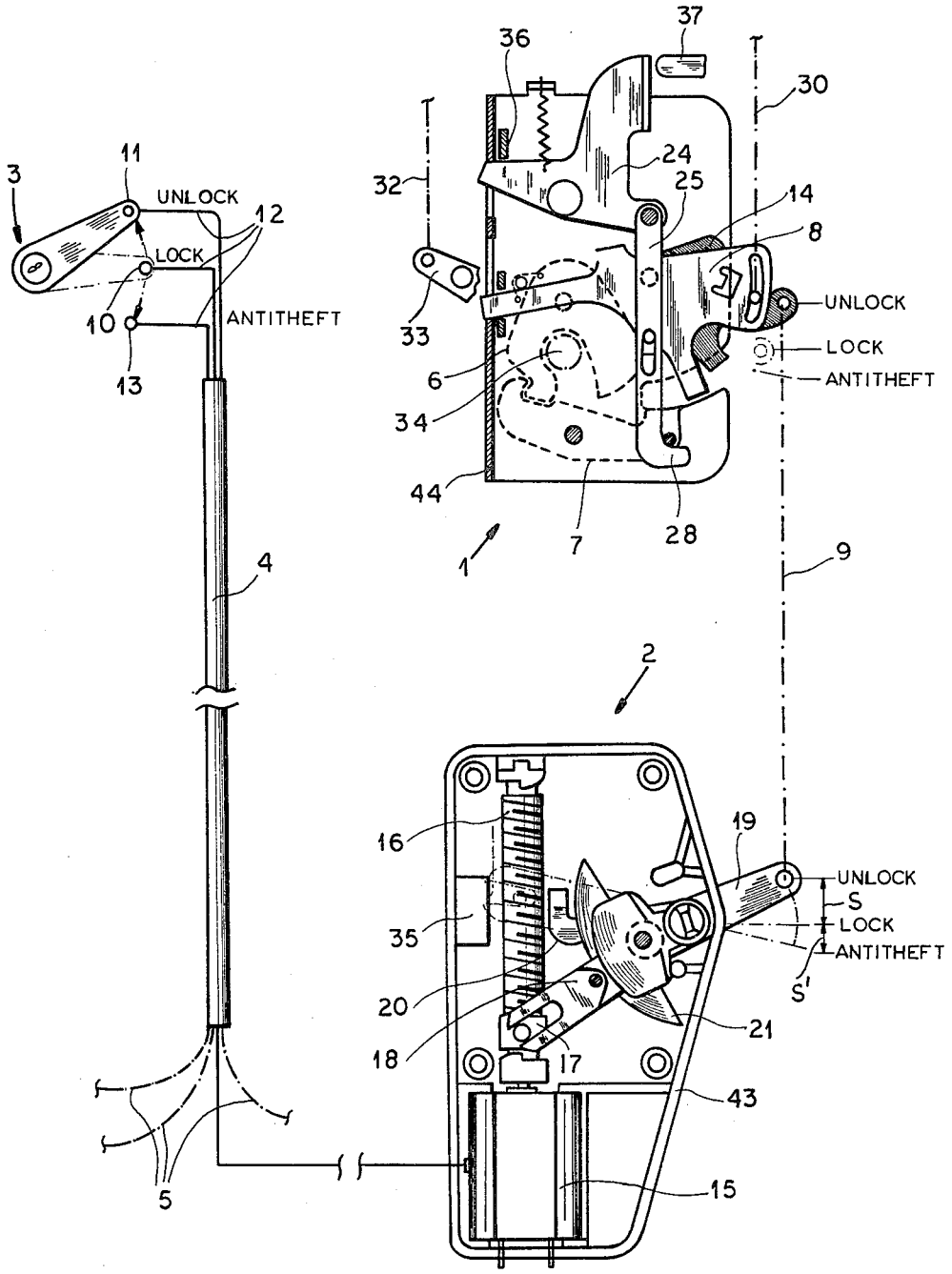
FIG. 1 is a partly schematic view illustrating the central lock system according to the instant invention.

FIG. 1 shows the system according to the instant invention which basically comprises a plurality of identical mechanical door latches 1 each having a respective servoactuator 2, all of which are controlled by a master switch 3 connected to a cable 4 having a branch 5 leading to each servoactuator 2. Only one door latch 1 and one servoactuator 2 are shown in the drawing, one such latch normally being provided at each vehicle door, and similar latching structure being provided at the trunk and hood.

The master switch 3 can connect to conductors 12 by means of a terminal 10 for the lock position, a terminal 11 for the unlock position, and a terminal 13 for the novel antitheft position according to the instant invention. This master switch 3 can be incorporated in the outside driver's door lock, or the antitheft terminal 13 can be provided as a separate key-operated switch which may advantageously be combined with a burglar-alarm switch. It is normally desired for the lock and unlock terminals or switch contacts 10 and 11 to be operable both from inside and outside the car, at the driver's door. To this end they may also be operable from the driver's door-lock button. The terminal or switch 13 for the antitheft position should, however, only be operable from outside the vehicle to prevent accidental locking-in of the occupants of a car.

Figure 2:
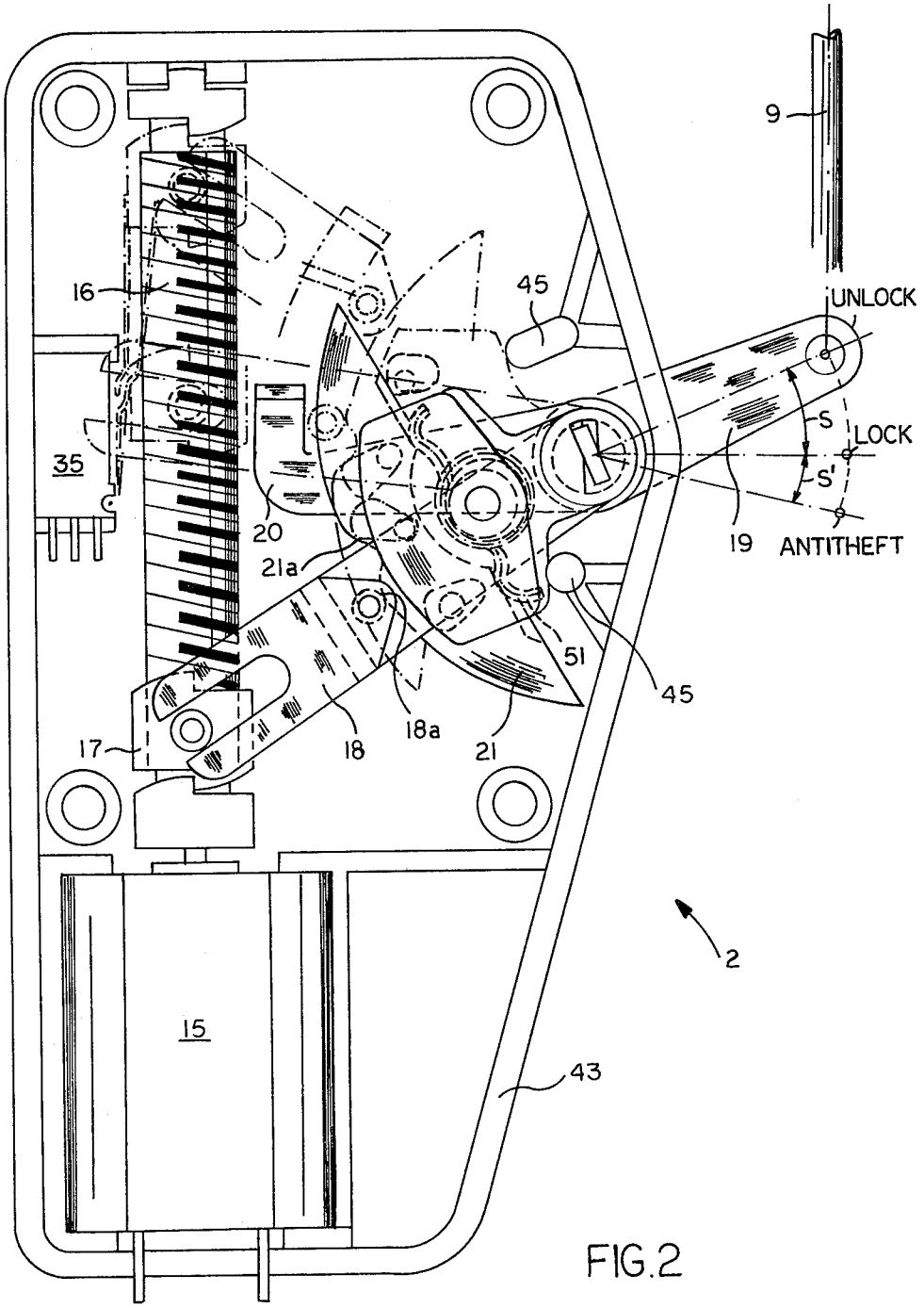
FIGS. 2 and 3 are large-scale views of details of FIG. 1.

As best seen in FIG. 2 each of the servoactuators 2 has a housing 43 fixed in the door adjacent the respective latch 1 and having a reversible servomotor 15 that is operated by the key switch 3 and by means of a microswitch 35 within the housing 43. This motor 15 carries a threaded spindle 16 having a nut 17 which is engaged with the forked end 18 of a two-arm lever whose other arm 19 can move limitedly relative to this arm 18. To this end the arm 19 is unitary with a segment 21 and with an entrainment arm 20. The segment 21 has a central notch **21*a* into which a spring 51 urges a roller at the end 18*a* of the arm 18. Thus the arms 18 and 19 are normally linked together as the roller at 18*a* engages in the notch 21*a*. As the arm 19 has end positions defined by formations 45 in the housing 43, this allows the nut 17 somewhat to overtravel the end positions of the levers 18, 19 without damage to it. Furthermore in the event the respective latch 1 is jammed this means the servoactuator 2** can operate without harming anything.

The switch 35 is operated by the nut 17 in the central lock position of the lever 18, 19. The switch 35 is furthermore normally connected to an indicator light on the dashboard to show the driver that the doors are locked. The entrainment arm 21 ensures that on displacement of the nut 17 upwardly along with the arm 18, the arm 19 will be entrained for positive actuation on displacement from the unlock to the lock and antitheft position. It is in the other direction of displacement that the roller is effective so as to prevent jamming of the lock or an attempted forcing of the door from overloading the structure of the servoactuator 2.

Figure 3:
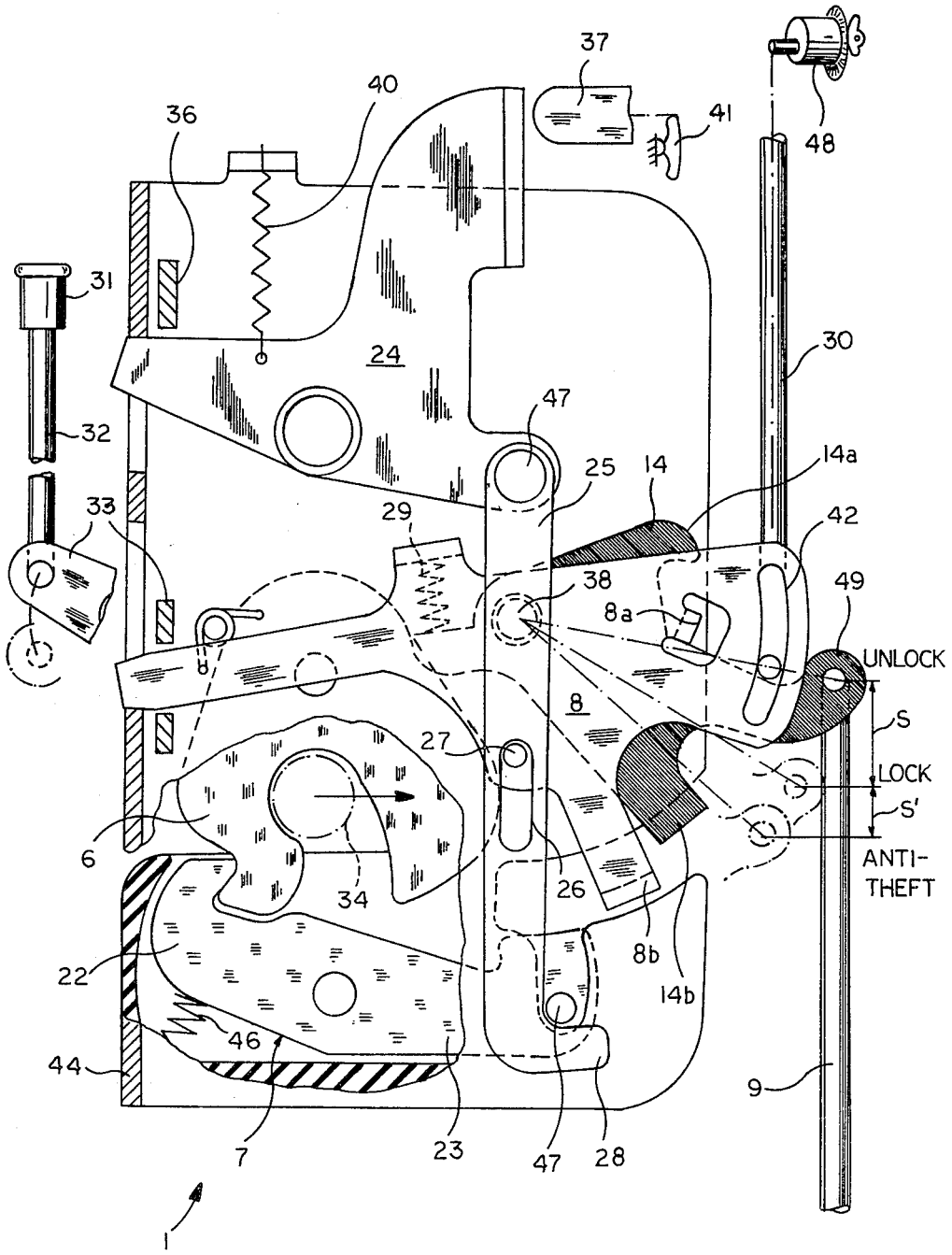

A rigid rod 9 is pivoted at one end on the lever arm 19 for displacement through a stroke S between the unlock and lock positions and through a smaller stroke S' between the lock and antitheft positions. This operation is similar to that described in my copending application Ser. No. 132,977, whose disclosure is entirely incorporated herewith. The other end of this rigid lever 9 is connected as best seen in FIG. 3 to an arm of an actuator lever or element 14 that is pivotal in the housing 44 of the latch 1 and that acts through a main pivotal latch member 8 and a secondary latch member 25 on a locking pawl 7 that in turn acts on the main detent fork 6 of the latch 1. The detent 6 is pivotal on the housing 44 and can capture a door bolt or pin 34 in the manner well known in the art. In turn the latch pawl 7 is pivotal on the housing 44 and has a hook end 22 urged by a spring 46 into engagement with one of the arms of the fork 6, and another arm 23 provided with a pin 47 on which a hooked end 28 of the secondary latch member 25 may engage. The actuating lever 14 and the main latch member 8 are jointly but independently pivotal about a pivot 38 on the housing 44, and a spring 28 is engaged between these two parts and couples them together for joint clockwise displacement.

In the unlock position illustrated in solid lines in FIG. 3 the end 28 is hooked over the pin 47 so that raising of the secondary element 25 will pivot the pawl 7 counterclockwise and release the fork 6 which in turn can release the pin 34 and open the respective door. The upper end of the secondary element 25 is connected to a pivotal element 24 urged clockwise by a tension spring 40 so as normally to push the element 25 down. A pusher 37 connected to an outside door handle can pivot the element 24 counterclockwise as can a lever 36 connected to an inside door handle for opening of the latch in the unlocked position.

Figure 4:
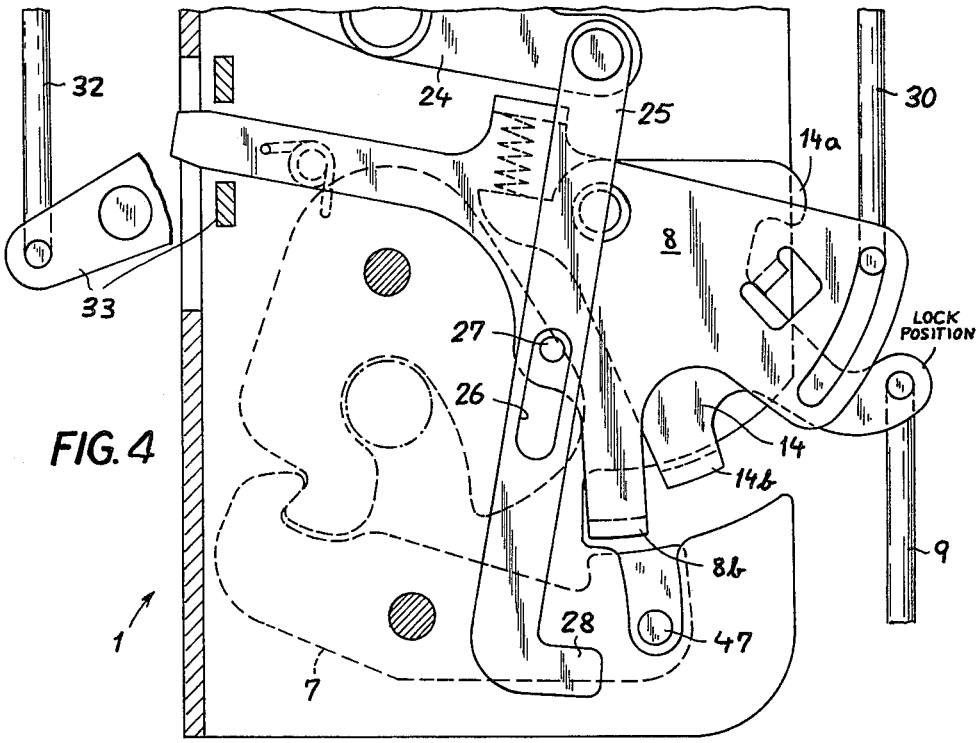

It is possible to move the latch 1 from the unlocked position shown in FIG. 3 to the lock position shown in FIG. 4 by pivoting the main latch member 8 clockwise. The secondary latch member 25 has a central slot 26 in which engages a pin 27 carried on this main latch member 8. Thus limited counterclockwise rotation of this member 8 will pivot the entire latch member 25 about its pivot 47 on the member 24 to move the hook 28 out of alignment with the pin 47. When thus misaligned upward displacement of the member 25 will be ineffective to operate the pawl 47, as the hook 28 will not engage the pin 47, but will pass ineffectively by it as is apparent from FIG. 4. The main latch member can be moved into this lock position either by depressing an inside door-lock button 31 connected via a rod 32 to a lever 33 that acts directly on an arm of the member 8. In addition operation of an outside door cylinder 48 will lower a rod 30 having an end engaged in the slot 42 in the member 8. The end of the rod 30 also engages the upper edge of the arm 49 of the actuating element 14 so that it will also pivot this element 14 clockwise and will bear via the spring 29 in the clockwise direction on the member 8 to pivot it into the lock position. In this lock position a tab **8*b* extending downward and inward from the member 8 will be aligned with the upper edge of the arm 23 of the pawl 7 so that upward displacement of this arm 23 and, therefore, counterclockwise pivoting of the pawl 7, will be impossible. This action effectively locks the latch 1. It is noted that downward displacement of the element 14 with the rod 9 will not be able to damage the respective servoactuator 2 as a result of the overload protection elements 18*a* and 21. In addition once it reaches the bottom end of its travel as is apparent from FIG. 3 the lower end of the rod 30 will directly contact the member 8** to pivot it into the lock position.

Figure 5:
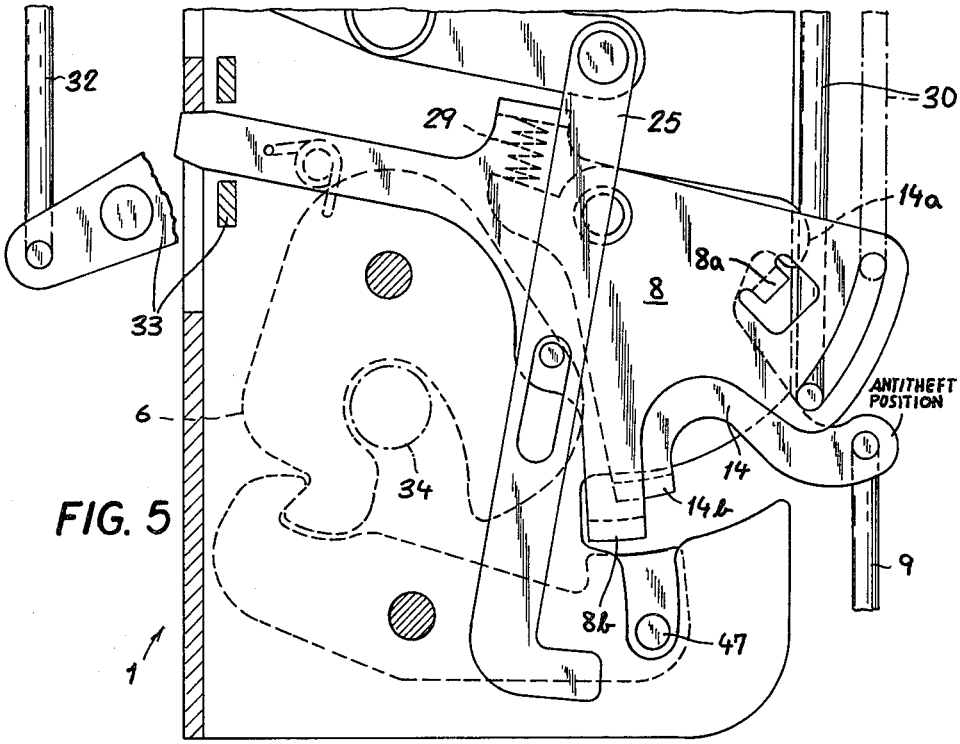
FIGS. 4 and 5 are views of portions of the structure of FIG. 3 in different positions.

When the switch 3 is operated to close the switch 13 and displace the rod 9 into the antitheft position, which can only done after displacing the mechanism into the lock position, this action as seen in FIG. 5 will bring a nose **14*a* of the element 14 into direct contact with the tab 8*a* of the element 8 and will positively retain the element 8 in the lock position. What is more a tab 14*b* of the element 14 aligns itself with the tab 8*b* to further prevent upward displacement of the arm 23 of the pawl 7. Therefore on displacement of the element 14 through the stroke S from the unlock to the lock position the spring 29 serves to transmit torque that similarly displaces the latch member 8 from the unlock to the lock position. On displacement from the lock to the antitheft position through the stroke S′, however, the element 14 positively and physically engages the element 8** to move it into and hold it positively in the lock position.

For this reason although it is possible to unlock the door when the parts are in the lock position by means of either the outside door cylinder 48 or the inside door button 31, when in the antitheft position neither of these actuating devices 31 or 48 can operate the latch. In the antitheft position the entrainment arm 20 engages the arm 18 so that the entire system is locked rigidly together. Furthermore virtually no amount of axially directed force on the nut 17 can cause the shaft 16 to operate so that this is in effect a one-way transmission. As a result once in the antitheft position the entire latch will be thoroughly blocked in its lock position, making forced entry into the vehicle virtually impossible.

Figure 6:
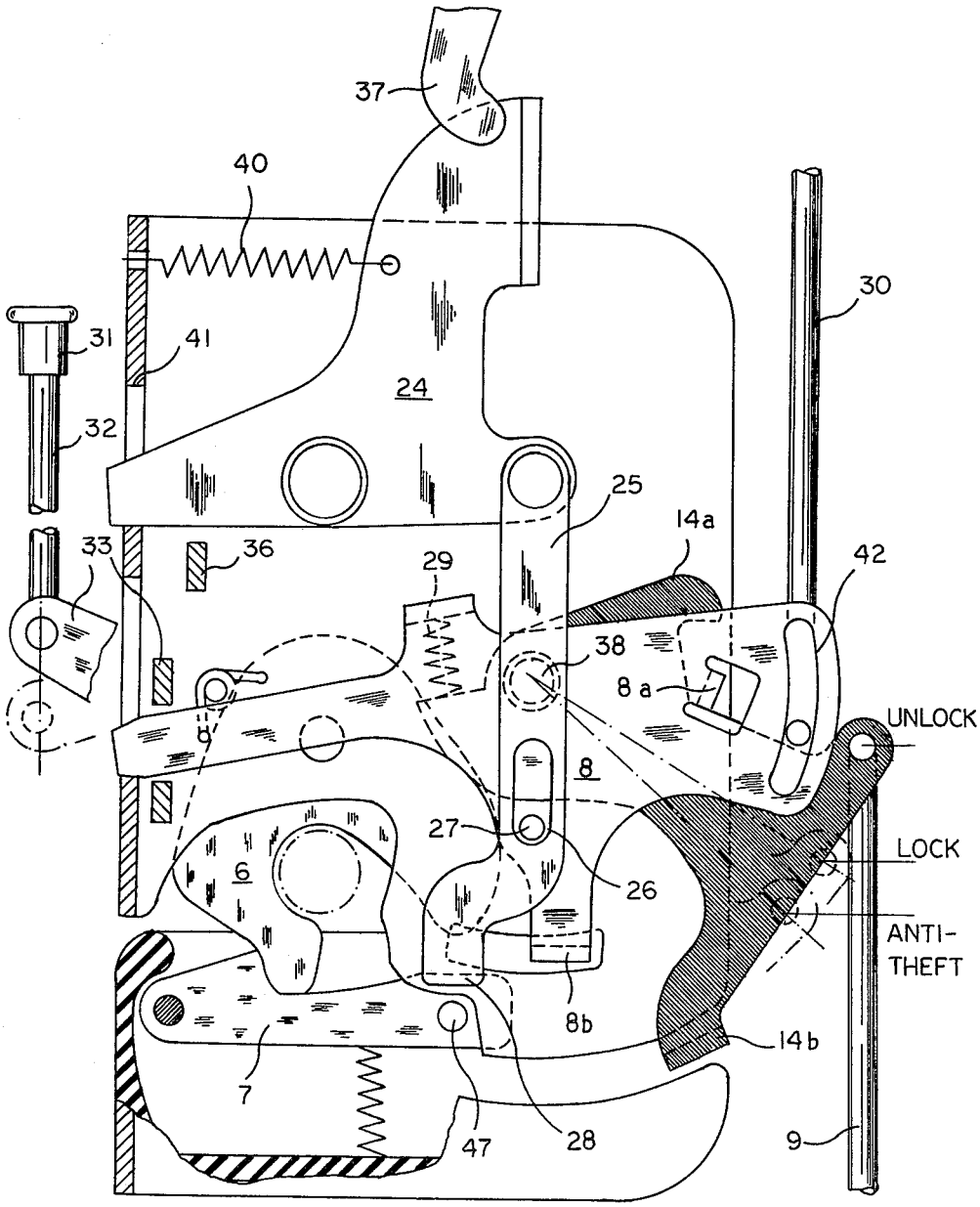
FIG. 6 is a view similar to FIG. 3 illustrating another door latch according to the instant invention.

FIG. 6 shows an arrangement wherein structure functionally identical to that of FIGS. 3–5 is assigned the same reference numerals. Here the principal difference is that the secondary latch element 25 acts to push the pawl 7 downwardly, and the tab **14*b* can hook under the pawl 7 to prevent such downward displacement. The tab 8*b*, instead of hooking under the pawl 7, hooks under the rear arm of the detent 6 to prevent its clockwise displacement similarly. Otherwise although the various levers are shaped somewhat differently, the functioning of this system is identical to that of FIGS. 3–5**.

Thus the lock system according to the instant invention has all of the advantages of a standard central locking system, plus the benefits of improved theft protection. Not only can the doors be locked centrally, but the various door latches can be blocked in the lock position so as to make forced entry an extremely difficult operation, even if a window can be opened. The extra structure and mechanism necessary to create this added theft protection adds little to the cost of the central lock system, and also is so set up that in the event of failure of the antitheft mechanism the car will not become hopelessly locked shut.

I claim:

1. A central door-lock system comprising:

a plurality of door latches each including a detent displaceable between a closed position securing the respective door to the respective doorpost and an open position permitting the respective door to separate from the respective doorpost, a manual door-opening handle, mechanism including a primary latch member connected to said handle and connectable to said detent and movable between a lock position preventing said handle from displacing said detent between said open and closed positions and an unlock position permitting said handle to displace said detent between said open and closed positions, means including a secondary latch member connected to said primary latch member and displaceable between a lock position urging said primary latch member into the respective lock position, an unlock position permitting said primary latch member to move freely between the respective lock and unlock positions, and an antitheft position positively holding said primary latch member in the respective lock position;

respective servoactuators for said latches each including an actuator element connected to the respective secondary latch member and means including a servomotor for displacing the respective secondary latch member via the respective actuator element between the respective lock, unlock, and antitheft positions; and means including a central switch connected to said servomotors for operating same jointly and thereby jointly displacing said secondary latch members between the respective positions.

2. The system defined in claim 1 wherein said servomotors each have a rotary output carrying a threaded spindle and said actuator elements are in threaded engagement with the respective spindle.

3. The system defined in claim 1 wherein each of said servoactuators includes:

a nut threaded on the respective spindle;

a two-arm lever forming the respective actuator element and pivotal on the respective servoactuator, each lever having one arm connected to the respective secondary latch member and another arm; and an overload coupling engaged between each nut and the respective lever, said nuts being in positive operative engagement with the respective other arms in the antitheft positions of the respective secondary latch members.

4. The system defined in claim 1 wherein each of said latches includes a fork constituting the respective detent, said mechanisms each including a pivotal pawl connected between the respective latch members and the respective detents.

5. The system defined in claim 1 wherein the latch members of each latch are pivotal therein about the same axis between the respective positions which are angularly offset from one another, said latches each including a spring braced angularly between the respective latch members, said secondary member of each latch bearing only via the respective spring on the respective primary member in the lock position but bearing positively and directly on the respective primary member in the respective antitheft position.

6. The system defined in claim 5 wherein said secondary members each have a bent out tab that directly engages the respective primary member in the antitheft position of the secondary member.

7. The system defined in claim 1 wherein each of said members of each latch has a portion positively blocking said mechanism against displacement of the respective detent into the open position in the lock positions of the respective latch members and in the antitheft position of the respective secondary latch member.

8. The system defined in claim 1 wherein each latch includes a manual door-locking element connected to the respective mechanism and displaceable between a lock position in which it moves the respective primary member into the respective lock position and an unlock position in which it moves the respective primary member into the respective unlock position.

9. The system defined in claim 8 wherein in the lock position of said manual elements the respective door handles are disconnected from the respective detents.

10. The system defined in claim 8 wherein said latch members of each latch are independently pivotal relative to each other between the respective lock and unlock positions.

* * * * *